United States Patent [19]

Nash et al.

[11] 4,416,842

[45] Nov. 22, 1983

[54] DIRECTED CRACKING IN CONCRETE PANEL MANUFACTURE

[75] Inventors: Richard C. Nash, New Prague; Terrance W. Duffy, Minneapolis, both of Minn.

[73] Assignee: Fabcon, Inc., Savage, Minn.

[21] Appl. No.: 239,330

[22] Filed: Mar. 2, 1981

[51] Int. Cl.[3] ..... B28D 1/26

[52] U.S. Cl. ..... 264/145; 264/160; 264/333

[58] Field of Search ..... 264/138, 333, 145, 160, 264/162; 83/30879, 880

[56] References Cited

U.S. PATENT DOCUMENTS

| | | | |
|---|---|---|---|
| 3,050,810 | 8/1962 | Lindbloom | 264/138 |
| 4,176,572 | 12/1979 | Pennington | 83/879 |
| 4,186,166 | 1/1980 | Hight | 264/145 |
| 4,213,550 | 7/1980 | Bonoddio | 83/880 |
| 4,340,557 | 7/1982 | Groso | 264/160 |

*Primary Examiner*—John A. Parrish

*Attorney, Agent, or Firm*—Schroeder, Siegfried, Vidas & Arrett

[57] ABSTRACT

A method of manufacture in which the formation of unsightly stress cracks in sandwich-like panels of prestressed concrete are prevented by the formation of a "contraction joint" at selected locations in the panel's outer layer of concrete during its manufacture.

7 Claims, 5 Drawing Figures

DIRECTED CRACKING IN CONCRETE PANEL MANUFACTURE

DESCRIPTION

Background of Prior Art

This invention is directed to an improved manufacturing method for the manufacture of sandwich-like panels of prestressed concrete. Specifically, it is directed to an improvement in the method wherein such sandwich panels are formed in factories as slab bodies of great length and are ultimately cut to individual desired panel lengths after completion of the formation and curing of the slab.

Concrete sandwich panels are well known products and have come into considerable use for wall panel members in building construction due to their improved resistance to the transmission of heat over that of ordinary concrete panels. Essentially, a sandwich panel in accordance with the term as used herein comprises a primary structural body of concrete in a substantially flat slab configuration that may or may not have hollow cores, depending upon intended usage. Immediately in contact with one face of the primary concrete layer is an insulating layer which is typically a panel of foam product such as polystyrene. Overlying the insulating layer is a second layer of concrete, usually thin relative to the primary layer, which covers the insulation to provide a weather and abrasion resistant outer surface for the panel. The outer layer of concrete is held in fixed relationship to the primary layer of concrete through the use of pin members. The pins extend through the insulating layer and are bonded to the primary and secondary concrete layers.

Desired manufacturing procedure for such panels involves forming them in slabs of great length and utilizing accelerating curing conditions by means of applied heat. Unfortunately, as a result of accelerated curing, there is a differential rate at which the relatively thick primary or supporting layer of concrete cures over the rate at which the relatively thin secondary or outer layer of the concrete cures. This is due to several factors, but is largely due to the fact that the insulating layer performs its function well and prevents a uniform flow of heat through the two separated layers of concrete so that they cannot cure at the same rates. Because of such differential heating rates between the layers of concrete, and the resultant curing thereof at different rates, the concrete layers exhibit different expansion and contraction relative to each other. This causes stress in the thinner secondary body resulting in a tendency to form stress cracks therein. Such cracks, while not harming the strength of the concrete or of the overall panel to any major extent, do produce a highly undesirable cosmetic effect, particularly when the secondary layer is frequently used as the outer decorative face of the panels.

Brief Summary of the Invention

In accordance with the present invention, while the slab is being formed or immediately thereafter, the concrete of the secondary or outer layer is indented transversely at pre-selected cutting locations. This is done while the concrete is still in the fluid state by forming a transverse indentation, such as a groove, across the concrete. Such indentations are generally referred to as contraction joints in the art. As a result, any stresses which build up due to differential curing and expansion rates find relief by producing a crack in the weakest area of the concrete i.e., in the groove or indentation. The grooves are positioned at the locations in the slab at which it is to be cut transversely to form individual panel lengths. Consequently, cracks are not present in the finished product.

BRIEF DESCRIPTION OF THE DRAWINGS

The invention will be best understood with respect to the drawings wherein

FIG. 2(*b*) is a cross-sectional view similar to that of FIG. 2(*a*) with the outer concrete layer in place and showing an indenting tool schematically for providing a transverse groove in the concrete.

FIG. 2(*c*) shows the slab of FIG. 2(*b*) after curing.

DETAILED DESCRIPTION OF INVENTION

Figure 1:
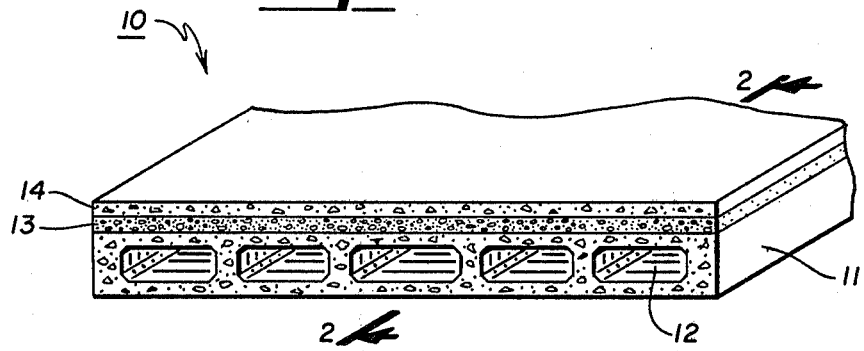
FIG. 1 is a cross-sectional perspective view of an end of a prestressed slab (hollow core type).

Referring to the drawings it will be seen that, in each of the Figures, like parts bear the same numerical designation. In FIG. 1 there is shown in cross-sectional perspective of an end view of a hollow core concrete sandwich slab 10 of conventional type and great length. While the invention is described with respect to hollow core slabs and panels it should be understood that the invention is equally applicable to the formation of sandwich panels without the hollow cores. The number, shape and arrangement of the cores may vary. The same is true of prestressing. That is, prestressing strands or other reinforcing cables or rods may be included and may vary in number, size and arrangement.

FIG. 1 illustrates the bottom primary or support layer of concrete 11 which includes rectangular openings 12 produced therein. Such hollow core slabs and panels can be produced by a variety of processes. One such process is shown in U.S. Pat. No. 3,217,375. The process for producing the hollow cores forms no direct portion of the present invention nor does the prestressing of the slabs. For present purposes it suffices that a concrete body 11 of considerable continuous length is to be joined to a layer of an insulating foam material 13 and an outer or secondary layer or skin 14 of concrete. Reinforcing strands or the like may also be included in layer 14. However, they would be of relatively small diameter or cross-section suitable for the thickness of layer 14. Typically such factory cast bodies are cast in great lengths in excess of 400 feet and are subsequently sawed by concrete saws into desired lengths. Layer 13 of the thermally insulating material is typically a polystyrene. While the thickness of polystyrene layer 13 may vary over a considerable range, it is typically in the range of about 1–6 inches thick, $2\frac{1}{4}$ inches being frequently used. Insulating material 13 has essentially zero abrasion resistance and tends to weather rapidly upon exposure to the elements. Therefore, it is standard practice to include the secondary or top, outer layer of concrete 14 to provide protection against the elements. Outer layer 14 may be either a smooth flat surface of concrete or it may be shaped into various ornamental configurations during the course of casting. As these additional features form no direct part of the present invention, they will not be elaborated on further here. As can be seen from the Figures, concrete layer 11 is preferably relatively thick compared to concrete layer 14.

Figure 2A:
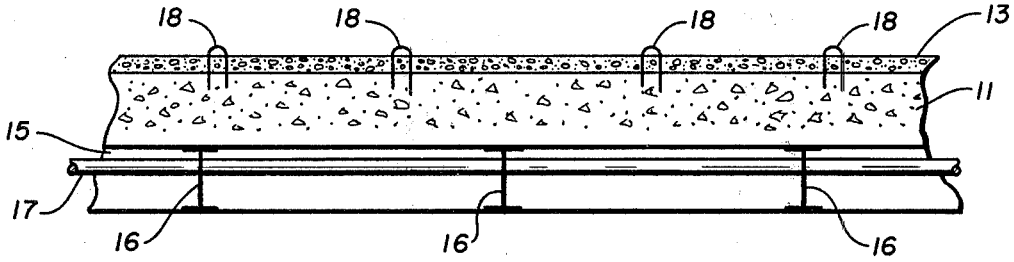
FIG. 2(*a*) is a cross-sectional view of a section of slab along line 2—2 of FIG. 1 during manufacture, showing the primary layer of concrete and insulation in place.
Figure 2B:
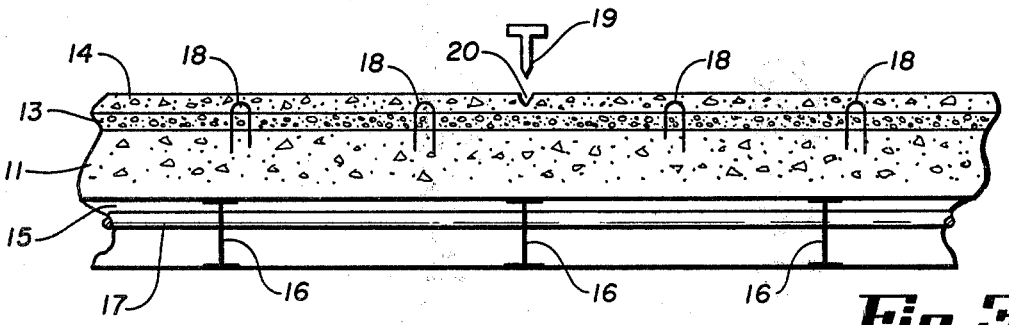
Figure 2C:
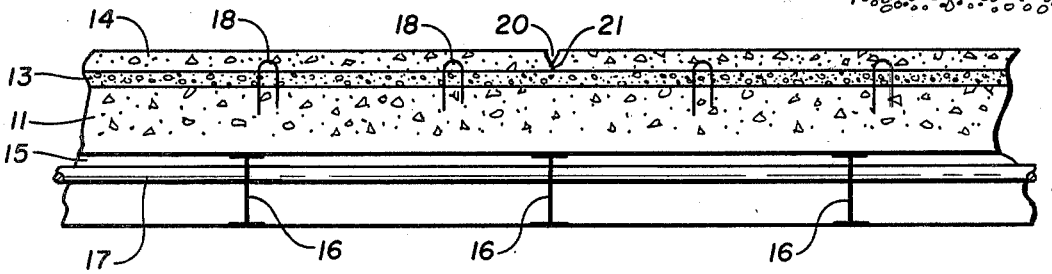

In the process of casting body 10 of FIG. 1, a flat casting bed having a pallet 15 is utilized. Pallet 15 provides a substantially horizontal working surface. Not shown are side forms which define the outer edges of the cast concrete. Pallet 15 is underlined by support members such as I-beams 16. Also typically, the pallet has joined to the underside thereof, some means for providing heat to accelerate the rate of curing of the concrete lying on the pallet. In FIGS. 2 this is illustrated as steam pipe 17 which delivers live steam at desired temperature, accelrating the curing process. Heat passes from pipe 17 through the bottom of pallet 15 and into lower layer 11 of the concrete. Usually there is provided a canopy or other suitable enclosure (not shown) over the entire body at the time the accelerated curing is taking place. However, the large majority of heat that enters body 10 does so by passing into concrete body 11 after passing through pallet 15 rather than being introduced into body 10 by convection from heated air lying above and below the pallet in the enclosure.

Other means of accelerated heating may be used. For example, it is well known in the art to use hot oil rather than steam in pipe 17 and it is also well known to use electrical heating elements attached to the bottom of the pallet in place of pipe 17 to provide the desired heat for curing.

Referring to FIG. 2(*a*), there are illustrated hairpin shaped members 18 which are utilized to hold insulation layer 13 onto the surface of the still wet, and uncured concrete layer 11. Layer 11 is typically on the order of about 8 inches in thickness. The hairpin members are inserted through the insulation 13 and penetrate into the still uncured concrete 11 as illustrated with a top portion of the hairpin projecting above layer 13. Onto the structure of FIG. 2(*a*) there is poured the additional layer of concrete 14. This layer of concrete flows around the upper edges of the hairpins 18 and ultimately upon curing, locks onto hairpins 18 which in turn are locked into layer 11, thus holding layer 14 fixed in relationship to layer 11 whereby the sandwich structure is formed with the insulation layer carried therebetween.

Figure 3:
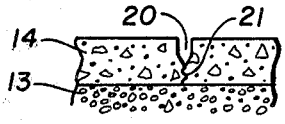
FIG. 3 is an enlarged sectional view of an indented portion showing a stress crack extending down to the foam layer.

After the sandwich structure has been formed, as above, the curing thereof is accelerated by means of heat applied primarily through base layer 11. The differential rate at which the heat is absorbed into layer 14 relative to layer 11 brings about differential expansion between the two layers during the heating cycle and during the cooling cycle after accelerated curing is completed. This introduces the aforementioned stresses into the top relatively thin layer 14 which may form undirected or haphazard stress cracks due to the differential expansion and contraction of layers 11 and 14. Illustrated in FIG. 2(*b*) is a blade or other suitably shaped tool member 19 which extends transverse to the length of the bed pallet and the continuous concrete body. It is utilized to indent the outer, still uncured layer 14 of concrete as shown at 20 by depressing it into the concrete to provide a transverse notch, groove or other suitable indentation therein. While the fluidity of outer layer 14 of concrete will not permit a complete cut-through of the concrete layer 14 by indentation therein of tool 19, retention of the groove or indentation does occur. This provides sufficient weakening at that point in the structure so that any differential expansion and contraction of layers 14 and 11 results in the generation of a transverse crack at the groove as illustrated in FIG. 2(*c*) and FIG. 3 at 21. Crack 21 in most instances extends completely through layer 14 down to the adjacent surface of foam 13. Thus, it can be seen that preferential or directed cracking can be made to occur at predetermined preferred locations in the continuous concrete sandwich structure.

In the process of the invention, spaced indentations are provided in the structure at the various locations where a saw cut is to be made in order to form the individual panels of desired length for ultimate use in the field. Thus, most cracks which form are at points where saw cuts will obliterate them and the finished panel lengths are relatively crack-free at their outer surface. Sawing is accomplished in any manner as is well known in the art.

Having described the preferred embodiment of the invention, it is to be defined by the following claims.

I claim:

1. In the method of manufacturing concrete panels wherein a length of substantially flat sandwich structure of concrete and insulation is formed, the structure having an upper concrete layer and a lower concrete support body layer, the insulation being carried intermediate the two, the concrete structure is cured, and then cut to form a plurality of individual panel lengths, the improvement comprising the step of forming indentations while the layer of concrete is still fluid and uncured, the indentations following the path of intended cuts, and subsequently after curing, cutting through the concrete structure along the indentations to form the individual panels, whereby undirected cracking in the upper surface is substantially eliminated.

2. The method of claim 1 wherein the indentations are formed in the upper concrete surface by depressing a tool therein to form a plurality of spaced indentations.

3. The method of claim 1 wherein the indentation is in the form of a groove.

4. The method of claim 1 wherein the indentation extends only partially through the upper concrete.

5. The method of claim 1 whereiin the indentation extends substantially through the upper concrete.

6. The method of claim 1 wherein the indentations are transverse to the length of the structure.

7. The method of forming a plurality of concrete panels of the sandwich type wherein a concrete sandwich structure of great length is formed, the length having a series of spaced proposed transverse cutting locations whereby a plurality of panels are formed from the continuous structure, wherein transversely extending indentations are formed at each of the proposed cutting locations on the upper surface of the structure in the concrete while the concrete is in the fluid state and prior to curing the concrete.

* * * * *